US005730435A

United States Patent [19]

Belanger et al.

[11] Patent Number: 5,730,435

[45] Date of Patent: Mar. 24, 1998

[54] APPARATUS FOR ABSORBING ENERGY DURING SIGNATURE DELIVERY

[75] Inventors: Roger Robert Belanger; Clifford Allen Zabkar, both of Dover; Michael Alexander Novick, New Durham, all of N.H.

[73] Assignees: Heidelberg Harris Inc., Dover, N.H.; Heidelberger Druckmaschinen AG, Heidelberg, Germany

[21] Appl. No.: 749,889

[22] Filed: Nov. 18, 1996

[51] Int. Cl.[6] ..... B65H 39/00

[52] U.S. Cl. ..... 270/52.14; 271/187; 271/315

[58] Field of Search ..... 270/52.14; 271/315, 271/187

[56] References Cited

U.S. PATENT DOCUMENTS 4,522,387 6/1985 Leuthold .
4,834,361 5/1989 Fenske et al. .
5,112,033 5/1992 Breton .
5,180,160 1/1993 Belanger et al. .
5,615,878 4/1997 Belanger et al. ..... 271/315

FOREIGN PATENT DOCUMENTS 0 390 736A2 10/1990 European Pat. Off. .

*Primary Examiner*—John T. Kwon
*Attorney, Agent, or Firm*—Burns, Doane, Swecker and Mathis, L.L.P.

[57] ABSTRACT

The present invention is related to an apparatus for delivering flat products, such as signatures, in a folding apparatus of a rotary printing press. At least one fan wheel assembly has a plurality of fan blades separated from each other by fan wheel pockets. The fan wheel pockets are defined by surfaces of the fan blades. A first surface of each fan wheel pocket is configured to cause the signature to take on an energy dissipating state.

16 Claims, 5 Drawing Sheets

APPARATUS FOR ABSORBING ENERGY DURING SIGNATURE DELIVERY

BACKGROUND OF THE INVENTION

1. Field of the Invention

The present invention relates to an apparatus for absorbing energy during signature delivery in a folding apparatus assigned to a rotary printing press.

2. State of the Art

U.S. Pat. No. 4,834,361 discloses a vane wheel laying out unit for sheet-by-sheet laying out of printed products in high speed rotary printing machines. A vane wheel is provided with a shaft and a plurality of thin vane star discs fixedly mounted on the shaft in a lamellar fashion at a distance from one another. A band supply unit is associated with the vane wheel for supplying printed products to the latter. A plurality of stationary air nozzles is also provided, each nozzle being associated with a respective one of the vane star discs of the vane wheel. The direction and intensity of air streams blown from the air nozzles influences the friction between a printed product falling in one vane and an outer side of another vane arranged after the one vane. The vane star discs, the band supply unit and the air nozzles are arranged relative to one another so that before ejection of a printed product's rear edge from the band supply unit, the printed product is blocked from the air streams of the air nozzles by the one vane which receives the printed product. During ejection of its rear edge, approximately one half of the printed product's length has been received in the one vane. After ejection of the printed product's rear edge, it is braked by the air streams of the air nozzles. A stripper is associated with the vane star discs of the vane wheel and formed as a rack adjustably engageable in intermediate spaces between the vane star discs. A pressure air conduit supplies the air nozzles with pressure which is controllable independently of the machine speed.

The vane star discs of this patent are shaped to accommodate braking of a printed product received in the vane star discs and accelerating of the printing product during stripping off by the stripper. However, the disclosed device relies upon the external force produced by the air nozzles to brake a signature's speed.

U.S. Pat. No. 4,522,387 discloses a device for stacking sheet shaped objects. The disclosed device includes several discs arranged adjacent one other on a driving shaft, the discs having spiral slots running from the outside towards the inside. The spiral slots of the several discs overlap in an axial direction, and together form a pocket into which a sheet is conveyed. The spiral slots of adjacent discs are staggered at least in an inner area of the device. Therefore, almost all of the kinetic energy of a sheet which has been inserted into a slot is dissipated by frictional engagement and flexing. Thus, this patent discloses the use of frictional engagement to dissipate the signature's kinetic energy. However, this frictional engagement requires heavy stripping forces which can damage folded signatures.

EP Patent Document No. 390 736 A2 discloses a device for reducing the impact of signatures when reaching the bottom of a fan pocket. A rotating shaft having two braking pads mounted thereon is assigned to the outer circumference of a fan wheel. The pads cooperate with rollers rotatably mounted on the inner side of an envelope curve of the fan wheel. The braking pads seize the signatures at their respective rearward edges and significantly reduce their kinetic energy before the signatures reach the bottom of the fan pockets. Thus, like the devices described above, an external force is used to assist in reducing signature speed.

U.S. Pat. No. 5,180,160 is related to a delivery device in a folding apparatus of a rotary printing press. The disclosed delivery device includes a fan wheel, or several fan wheels disposed next to one another. The fan wheels are formed of individual fan blades, between which fan wheel pockets are formed. Leading edges of the fan blades have a first profile and trailing edges of the fan blades have a second profile. In the disclosed embodiment, only a signature's lead edge is impacted upon to reduce its speed and kinetic energy before it reaches the bottom of a fan wheel pocket.

According to the foregoing state of the art, the fan wheels work within a folding apparatus and rotate at a much lower velocity than that of signatures coming into the fans. Typical reduction ratios are 1:8 to 1:15. Given these reduction ratios, damage of a signature's leading edge when it reaches the bottom of a fan wheel pocket is practically inevitable.

SUMMARY OF THE INVENTION

Accordingly, one object of the present invention is to significantly reduce and/or eliminate signature lead edge damage due to high impact with the bottom of a fan wheel pocket. Such a feature is achieved by reducing the impact force on the lead edge of a signature as it contacts the bottom of the fan pocket.

According to the present invention, exemplary embodiments of an apparatus for delivery of flat products, such as signatures, comprise:

at least one fan wheel assembly having a plurality of fan blades separated from one other by fan wheel pockets, each fan wheel pocket being defined by surfaces of said fan blades; and a first surface of each fan wheel pocket further including at least one relief portion which defines a first raised portion of the fan wheel pocket, said relief portion providing energy dissipation of said signature.

Exemplary embodiments of the present invention provide significant advantages. For example, the two variables which define the kinetic energy of the signature and which are responsible for the impact force on the lead edge of the signatures are influenced; i.e. the signature distribution velocity and the distribution of the mass of the signature. Due to a first energy absorbing profile of the fan wheel pocket, absorption of kinetic energy is performed not only by a bottom of a fan pocket, but rather is also performed by the first surface of the fan wheel pocket. Thus, the amount of kinetic energy absorbed by the bottom of a fan wheel pocket is significantly reduced. Consequently, the impact on a signature's lead edge is significantly reduced, thereby reducing and/or eliminating damage.

Further, the impact on a signature's lead edge is reduced by allowing the entire signature, and not just its lead edge, to absorb the signature's kinetic energy. For example, relief portions are formed on the first surface, between which an additional raised portion is defined. The relief portions and the raised portion can, for example, be directly machined in segments of the fan blades, or on removable segments configured to be retrofit in an existing fan blade. The segments can be configured for easy fastening using, for example, snap-on devices or the like.

The relief portions advantageously can be provided on the first surface at a location along a length of the first surface which extends half the distance from the bottom of a fan wheel pocket to a signature's trail edge, thus providing an energy absorbing area besides the bottom of a fan wheel pocket.

Further advantageous embodiments of the present invention can include a second surface of the fan wheel pocket which comprises a series of arcs to provide a smooth unrestricted stripping of signatures from the fan wheel pockets. A stripping device is assigned to at least one fan wheel assembly for interacting with the second trailing surface at an angle of, for example, between 95 and 100 degrees. Further, in an exemplary embodiment, the stripping device interacts with the second trailing surface for at least 25 degrees of rotation of the fan wheel assembly.

In a further advantageous embodiment of the present invention, the fan wheel pockets are narrowly confined towards their respective pocket bottoms. For example, a length of the fan wheel pocket close to the bottom of the fan wheel pocket can have a width which varies between 0.07 and 0.09 inches (e.g., for at least the last 1.5 inches along a length of the fan wheel pocket which extends from the bottom of pocket).

BRIEF DESCRIPTION OF THE DRAWINGS

Features of the invention, together with additional objects and advantages thereof, will be best understood from the following description of specific embodiments when read in connection with the accompanying drawings, wherein.

DETAILED DESCRIPTION OF PREFERRED EMBODIMENTS

Figure 1:
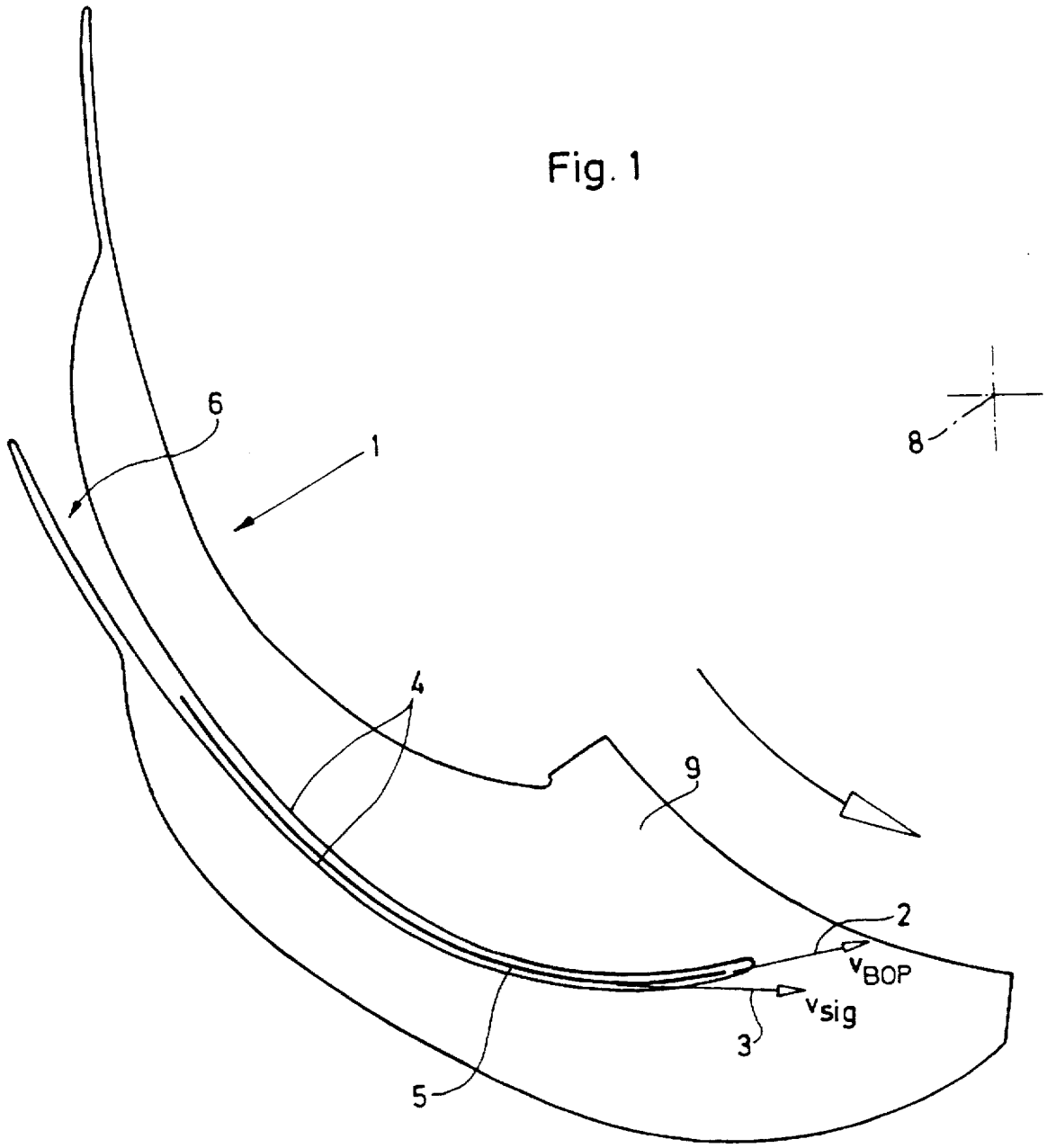
FIG. 1 shows a conventional fan pocket profile.

FIG. 1 shows a schematic view of a conventional fan pocket profile. A signature 5 entering a fan wheel pocket having a conventional profile 1 arrives at the bottom of pocket 6 with a high speed $v_{sig}$. Since no deformation of the signature by the fan pocket profile 4 is likely to occur, all the kinetic energy of the moving signature is absorbed by the bottom of the pocket, resulting in damage to the signature's lead edge. During rotation of the segment 9 about an axis of rotation 8, ejected signatures are collected in a shingled formation and conveyed for further processing. A fan pocket according to FIG. 1 may be sufficient for signature input delivery speeds of, for example, between 1000 to 2000 feet-per-minute to generate signature slowdown via friction. However, for higher delivery speeds, the slowdown via friction alone is not sufficient. Additional external forces, as mentioned in the prior art patents previously discussed, have therefore been conventionally used.

Figure 2:
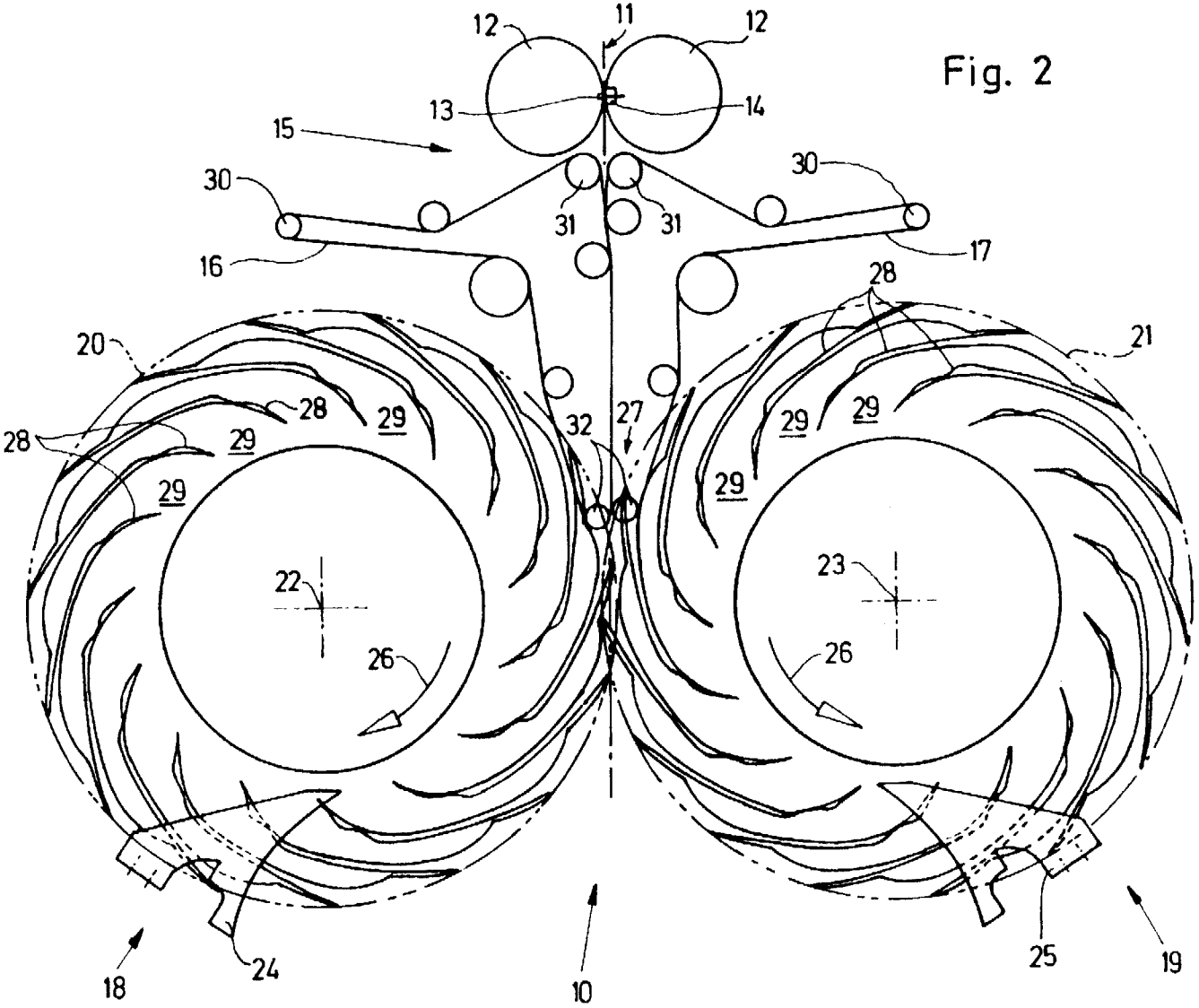
FIG. 2 shows a signature delivery of a folding apparatus in greater detail.

FIG. 2 shows a folding apparatus having a signature delivery according to the an exemplary embodiment present invention. Following a vertically extending web path 11, a web of material passes cutting cylinders 12. The cutting cylinders 12 include one or more knives 14 cooperating with anvils 13 to severe signatures from the leading portion of the web of material. The severed signatures are conveyed into tapes 15. The tapes 15 include a left conveyor tape 16 and a right conveyor tape 17. The conveyor tapes 16, 17 also comprise entry rollers 31 and exit rollers 32. The tapes are tensioned by tensioning rollers 30. The exit rollers 32 can be arranged, for example, in a staggered manner. The exit rollers 32 of the conveyor tapes 16, 17 are mounted within a signature entry area 27. The signature entry area 27 is defined by the respective envelope curves 20, 21 of the fan wheel assemblies 18, 19.

The fan wheel assemblies 18, 19 rotate about rotation axes 22, 23 in respective directions 26. Since the envelope curves 20, 21 of the fan wheel assemblies 18, 19 overlap each other, every other signature ejected from the conveyor tapes 16, 17 enters into a fan wheel pocket 28 of the fan wheel assemblies 18, 19 in the manner described in U.S. Pat. No. 5,112,033, the disclosure of which is hereby incorporated by reference in its entirety.

The fan wheel assemblies 18, 19 rotating about rotation axes 22, 23 each comprise a plurality of fan blades 29, defining with their respective edges, fan wheel pockets 28. A stripper 24, 25 is assigned to each of the fan wheel assemblies 18, 19 to smoothly remove signatures previously inserted into the fan wheel pockets 28. The strippers 24, 25 each include a curved surface for contacting a signature's leading edge during removal from the pockets 28. As shown in FIG. 2, the strippers are arranged in the lower region of the fan wheel assemblies 18, 19.

Figure 3A:
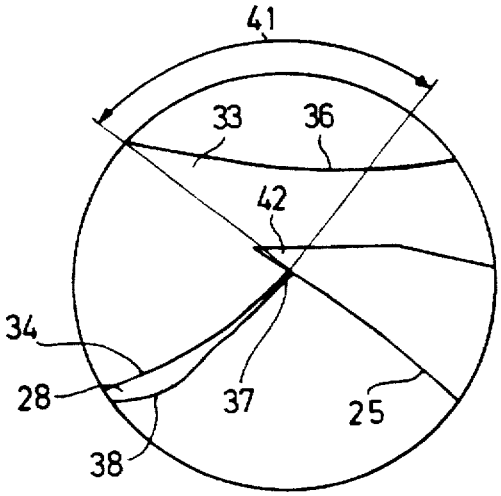
FIG. 3*a* shows a stripper tip interacting with a fan pocket according to an exemplary embodiment of the present invention.
Figure 3:
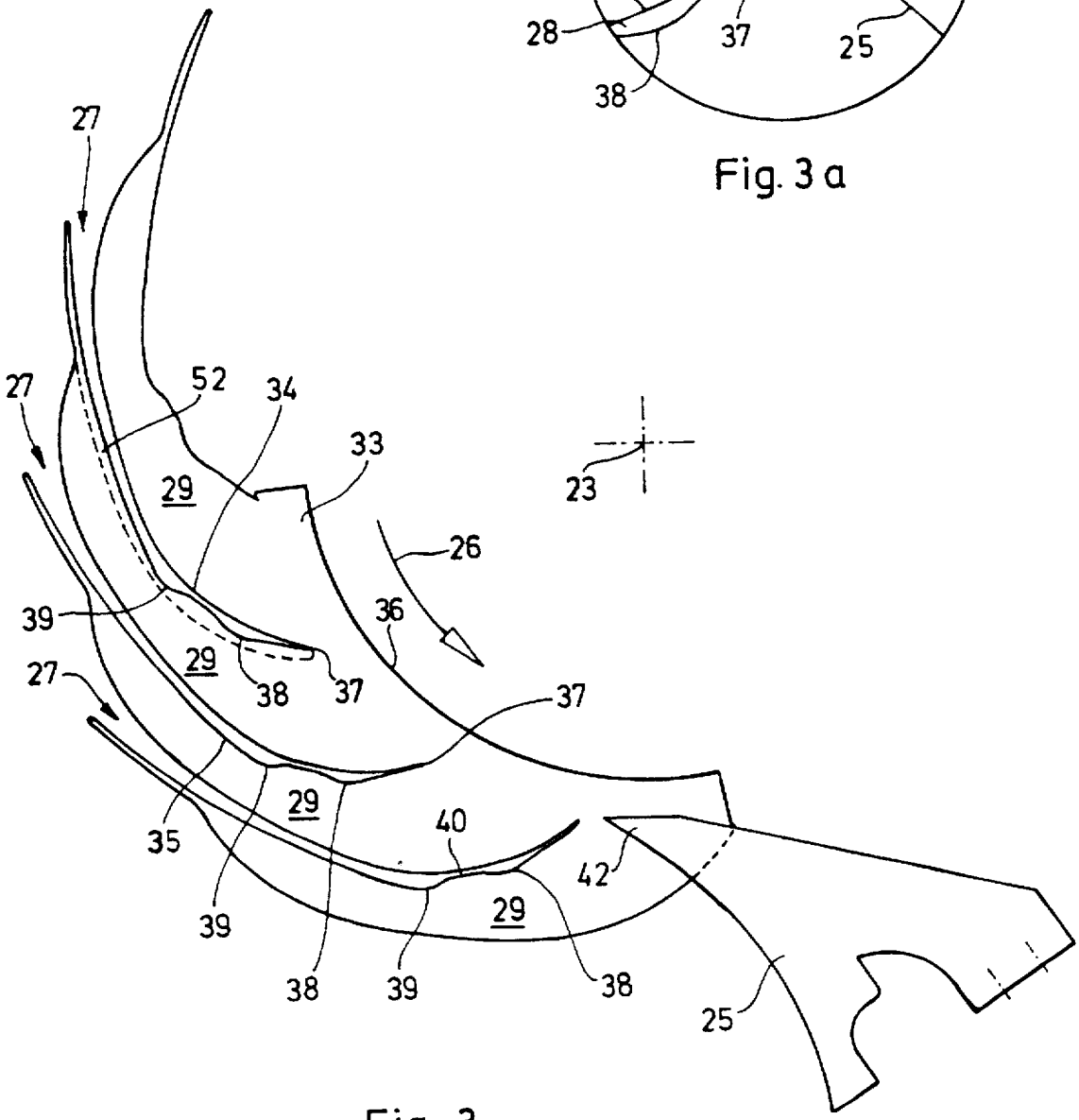
FIG. 3 shows a fan pocket profile according to an exemplary embodiment the present invention.

FIG. 3 shows a segment 33 of a fan wheel assembly having a plurality of fan blades and fan wheel pockets arranged on its circumference. The segment 33 has an arc-shaped mounting surface 36 for mounting on a disc-shaped element rotating about axis of rotation 23. The segment 33 comprises four fan blades 29 defining fan wheel pockets 28 each having an entry section 27.

The fan wheel pockets 28 are each defined by a first leading surface 35 and a second trailing surface 34. The trailing surface 34 comprises a series of arcs to provide a smooth and unrestricted removal of a signature previously inserted into the fan wheel pocket 28, upon rotation of the segment 33 about axis 23.

The leading surface 35 comprises at least two relief portions 38, 39. In accordance with an exemplary embodiment, the relief portions 38, 39 are shaped as recesses in the leading surface 35. The relief portions 38, 39 define a raised portion 40 that constitutes at least a first narrow passage between the recesses in the fan wheel pocket 28. Although only two relief portions 38, 39 are shown in FIG. 3, the number of relief portions and raised portions can be increased. Exemplary embodiments include portions 38, 39 and 40 arranged at a location along the first leading surface 35 which is within a first half of the distance from the bottom 37 of a fan wheel pocket 28 to a signature's trailing edge 45 (see FIG. 4). It should be mentioned that a removable segment 52 (shown with dotted lines in FIG. 3) can be provided with the relief portions 38, 39, so that a raised portion 40 can be retrofit to each fan wheel pocket of an already existing fan wheel. The removable segment 52 can be attached in place using any conventional manner of attachment, such as snap on connections formed as C-clips which are attached to segment 52 and which clip-on to a pre-existing fan wheel blade. Such a feature enables existing fan wheel assemblies to benefit from the invention by enhancing and increasing their performance.

As shown in FIG. 3*a*, stripper 25 has a tip 42 and is assigned to segment 33 upon rotation its about axis 23. The stripper 25 includes a curved surface to smoothly remove signatures out of the pockets 28 upon rotation, by contacting a signature's lead edge. While a stationary stripper can be used, those skilled in the art will appreciate that adjustable strippers, whose position is adjustable relative to the trailing edge of the fan wheel pocket, can also be used.

FIG. 3*a* also provides detail of a fan wheel pocket 28. As shown therein, the fan pocket is narrowly confined, being slot-shaped. An exemplary width of the pocket illustrated in FIG. 3*a* varies along at least a portion of the pocket's length from between 0.07 and 0.09 inches for typical signature thicknesses. This narrow width extends over at least a portion of the fan wheel pocket 28 located toward the bottom of the pocket (e.g., over a last 1.5 inches along a length extending from a bottom of the fan wheel pocket). However, the narrow width can extend to include the first narrow passage between the relief portions 38, 39, and any other portion of the fan wheel pocket 28. Such a feature provides further dissipation of kinetic energy prior to a signature lead edge contacting the pocket bottom 37. Upon contacting the pocket bottom, the narrow passage also serves to effectively stiffen the lead edge allowing it to withstand higher impact forces.

In FIG. 3*a*, the stripper tip 42 is oriented towards the fan wheel pocket 28. The stripper tip 42 interacts with the trailing edge 34 of the fan wheel pocket at an angle 41 (i.e., an angle defined by lines tangential to the trailing edge 34 and an edge of the stripper). In an exemplary embodiment, the angle 41 is selected to provide a smooth and unrestricted signature stripping out of the fan wheel pocket. In an exemplary embodiment, the angle 41 is selected to be approximately 95 to 100 degrees, more or less. The contact angle 41 is maintained during intersection of the signature's lead edge and stripper tip 42 for at least a portion of the fan/stripper crossing (e.g., for approximately 25 degrees of rotation of the fan wheel assembly).

Figure 4:
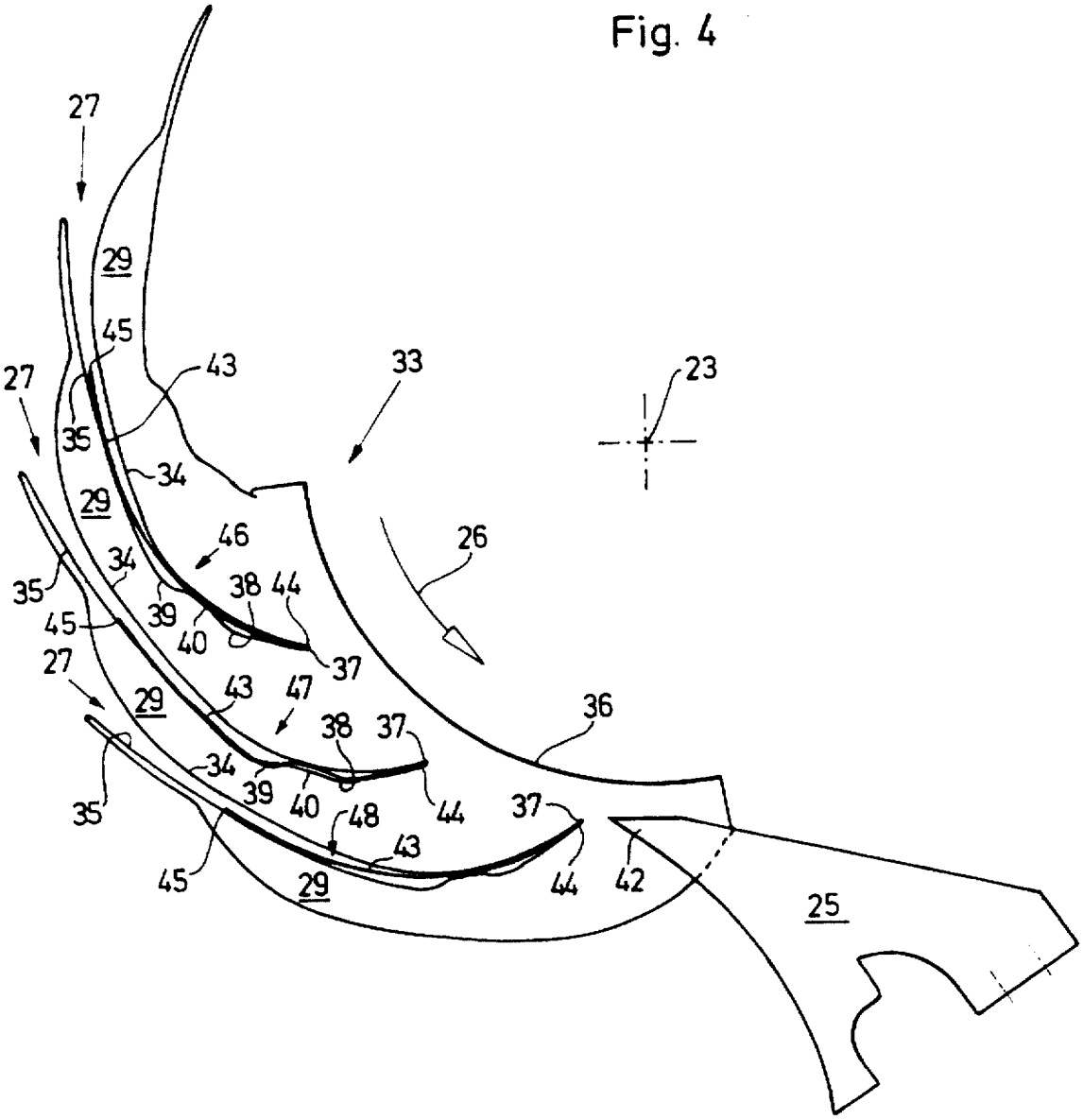
FIG. 4 shows an exemplary sequence of the different states a signature adopts upon impact with a pocket.

FIG. 4 is a view of a segment 33 similar to the view in FIG. 3 but showing different exemplary states a signature adopts according to an exemplary embodiment of the present invention. The signature 43 has a leading edge 44 as well as a trailing edge 45. Its entry into a respective fan wheel pocket 28 via the entry section 27 is completed in a state labelled 46, i.e. the signature's "free" state of travel. In this state, the kinetic energy $E_{kin}=mv^2/2$ of the signature has not been significantly reduced.

In the signature's state 47 (shown below the free state of travel 46), the signature lead edge 44 has contacted the pocket bottom 37. The signature 43 adopts the "collapsed" state 47 upon contact with the pocket bottom 37. However, the kinetic energy mentioned with respect to state 46 is absorbed not only by the pocket bottom 37, but by the first relief portion 38 and the second relief portion 39. Thus, only a fraction of the signature's kinetic energy is dissipated at the pocket bottom 37 upon impact, thereby significantly reducing the lead edge's risk of damage. The profile of leading surface 35 contributes to the dissipation and absorption of the signature's kinetic energy, as does the narrowly confined slot of the fan wheel pocket 28. (e.g., the narrowly confined slot which extends over the last 1.5 inches from the bottom of pocket 37).

Upon further rotation of segment 33, the signature 43 returns to its free state of travel. This is illustrated as state 48 of FIG. 4.

Figure 5:
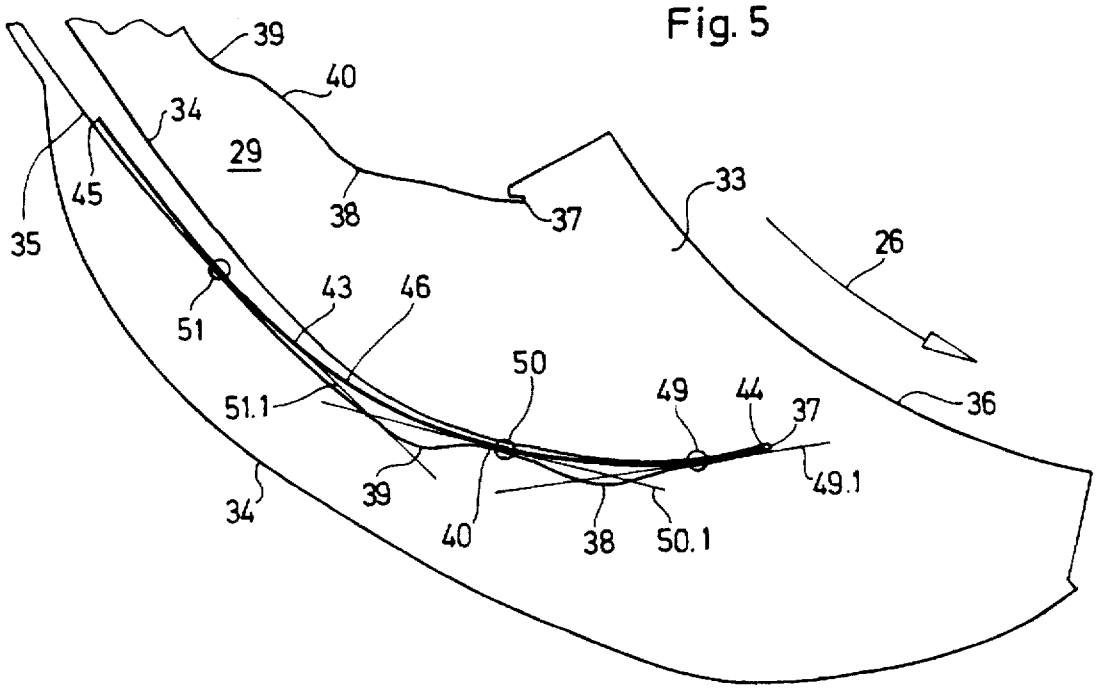
FIGS. 5 and 6 show a signature divided into three different submasses, the deformation of the signature during dissipation of kinetic energy being shown by tangential lines.

FIG. 5 further illustrates a signature's free state of travel 46. The signature 43 has been completely inserted into a fan wheel pocket 28, and is shown shortly before contacting the pocket bottom 37. The signature 43 is shown to be divided into three distinct submasses 49, 50, 51. The first submass 49 is inserted into the narrowly confined slot of the fan wheel pocket 28, between the pocket bottom 37 and the first relief portion 38, as indicated by tangent 49.1. A second submass 50 contacts the raised portion 40 as indicated by a tangent 50.1. A third submass 51, as indicated by tangent 51.1, contacts the leading surface 35 of the fan wheel pocket 28.

Figure 6:
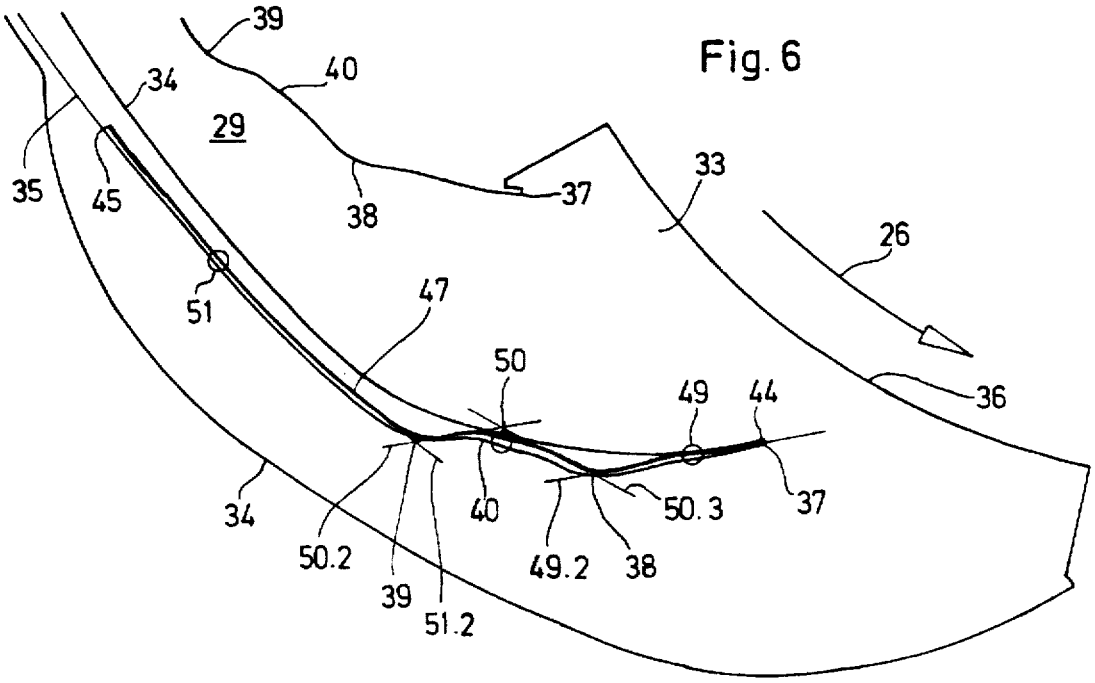

FIG. 6 shows the energy-dissipating, "collapsed" state 47. In FIG. 6, the signature 43 is again subdivided into the three aforementioned submasses 49, 50 and 51 respectively. In this state, submass 49 is absorbed by the pocket bottom 37. Submass 50 of the signature moves partly into the first relief 38. This is indicated by tangents 49.2 and 50.3 of the signature 43 in the "collapsed" state 47. Submass 51 of the signature 43 has moved into the second relief 39, as indicated by tangents 50.2 and 51.2. Consequently, the second submass 50 no longer contacts the raised portion 40, but instead moves towards the trailing surface 34 which is located opposite the raised portion 40. Thus, the signature: (1) moves into the reliefs 38, 39 of the leading edge 35; (2) moves away from the raised portion 40 into contact with the opposite trailing surface 34; and (3) has its leading edge 44 inserted into a narrowly confined slot. As such, considerable fractions of the signature's kinetic energy are absorbed by surfaces of the fan wheel pocket and by the signature in its entirety. Thus, the fraction of kinetic energy to be absorbed by the pocket bottom 37 is significantly reduced.

It will be appreciated by those skilled in the art that the present invention can be embodied in other specific forms without departing from the spirit or essential characteristics thereof. The presently disclosed embodiments are, therefore, considered in all respects to be illustrative and not restricted. The scope of the invention is indicated by the appended claims rather than the foregoing description, and all changes that come within the meaning and range and equivalence thereof are intended to be embraced therein.

What is claimed is:

1. Apparatus for delivery of signatures comprising:

at least one fan wheel assembly having a plurality of fan blades separated from one another by fan wheel pockets, each fan wheel pocket being defined by surfaces of said fan blades; and a first surface of each fan wheel pocket further including at least two relief portions which define a raised portion of the fan wheel pocket and are placed at locations along said first surface which are within a first half of a distance from a bottom of the fan wheel pocket to a trail edge of a signature to be delivered, said relief portions providing energy dissipation of said signature.

2. Apparatus according to claim 1, wherein said first surface and a bottom of each pocket absorb energy of said signature.

3. Apparatus according to claim 1, wherein said first surface is a leading surface of said fan wheel pocket.

4. Apparatus according to claim 3, wherein said first surface is configured for mounting to said fan blades as a removable segment.

5. Apparatus according to claim 1, wherein said raised portion extends from said first surface toward a second surface of the fan wheel pocket.

6. Apparatus according to claim 3, wherein said first surface comprises at least two relief portions.

7. Apparatus according to claim 6, wherein said raised portion is located between said two relief portions.

8. Apparatus according to claim 1, wherein said surfaces are configured to position said signature to take on an energy dissipating state under the signature's own mass.

9. Apparatus according to claim 1, wherein a second surface of each fan wheel pocket comprises a series of arcs.

10. Apparatus according to claim 9, wherein said second surface is a trailing surface of said fan wheel pocket.

11. Apparatus according to claim 1, further comprising:

a stripping device assigned to said at least one fan wheel assembly.

12. Apparatus according to claim 11, wherein said stripping device intersects a trailing surface of said fan wheel pocket at an angle of between approximately 95 and 100 degrees.

13. Apparatus according to claim 12, wherein said stripping device intersects said trailing surface of said fan wheel pocket at said angle during at least 25 degrees of rotation of the fan wheel assembly.

14. Apparatus according to claim 1, wherein said fan wheel pocket is narrowly confined along at least a portion of its length which is located towards a bottom of the fan wheel pocket.

15. Apparatus accord ing to claim 14, wherein a width of said fan wheel pocket varies from between approximately 0.07 inches and 0.09 inches along said at least a portion of said length.

16. Apparatus according to claim 15, wherein said portion of said length extends at least 1.5 inches from the fan wheel pocket bottom.

* * * * *